United States Patent [19]

Hyodo

[11] 3,983,355

[45] Sept. 28, 1976

[54] SWITCHING APPARATUS

[75] Inventor: Masayoshi Hyodo, Aichi, Japan

[73] Assignee: Kabushiki Kaisha Tokai Rika Denki Seisakusho, Aichi, Japan

[22] Filed: June 19, 1974

[21] Appl. No.: 480,803

[52] U.S. Cl. ..... 200/264; 200/159 R; 200/16 R

[51] Int. Cl.[2] ..... H01H 1/02

[58] Field of Search..... 200/264, 153 LA, 159 B, 200/16 R; 338/100, 114, 118, 2

[56] References Cited

UNITED STATES PATENTS

| | | | |
|---|---|---|---|
| 3,800,112 | 3/1974 | DuRocher | 200/264 X |
| 3,819,895 | 6/1974 | Pittman et al. | 200/264 X |
| 3,873,795 | 3/1975 | Leighton et al. | 200/264 X |
| 3,879,586 | 4/1975 | DuRocher et al. | 200/264 X |

*Primary Examiner*—Herman Hohauser
*Attorney, Agent, or Firm*—Pollock, Vande Sande & Priddy

[57] ABSTRACT

A switching apparatus in which at least one pair of contact electrodes is printed on an insulator base fixed to a switch casing, and a contact element of conductive elastomeric material is disposed at a suitable position opposite to these contact electrodes to be compressed by a compressing force imparted by a pressure imparting member. The switch is turned on when the contact element is compressed and turned off when the contact element is not compressed.

15 Claims, 18 Drawing Figures

SWITCHING APPARATUS

BACKGROUND OF THE INVENTION

This invention relates to switching apparatus, and more particularly to improvements in a switching apparatus suitable for controlling a relatively low current.

Switching apparatus for making and breaking an electrical circuit are known in a variety of types. A commonly conventionally known switching apparatus comprises a stationary contact and a movable contact, and the movable contact is urged toward and away from the stationary contact to make and break an electrical circuit. This conventional switching apparatus has been defective in that trouble such as mal-contact tends to occur within a short period of time of use due to mechanical wear occurring on the contact surfaces and generation of an arc jumping across the contacts during actuation of the switch. Conventional switching apparatus has further been defective in that a connection between each contact point and and a lead wire is required and circuit disconnection at this connection occurs frequently.

SUMMARY OF THE INVENTION

With a view to obviate prior art defects as above pointed out, the present invention contemplates the provision of a novel and improved switching apparatus comprising a switch casing, an insulator base fixed to the switch casing, at least one pair of contact electrodes printed on the insulator base, a contact element of conductive elastomeric material disposed at a suitable position opposite to the contact electrodes, and a pressure imparting member for imparting a compressing force to the contact element, so as to turn on the switch by utilizing the fact that the contact element is rendered electrically conductive only when it is compressed.

According to the present invention, the contact element disposed opposite to the contact electrodes is made by dispersing fine particles of conductive metal in a mass of non-conductive elastomer such as porous or non-porous silicone rubber. This element shows a substantially infinite high electrical resistance in a non-compressed state, but with impartation of a compressing force to the element, the elastomer is compressed and the fine metal particles are brought into contact with one another to render the element electrically conductive. The use of such contact element eliminates the need for provision of contact make-break means making mechanical motion relative to the contact electrodes so that undesirable wear of the contacts can be substantially avoided and the durability of the switching apparatus can be improved. Further, due to the fact that no arc jumps across the contact element and the contact electrodes during on-off operation of the contacts, no appreciable wear occurs on the contacts. As a result of elimination of wear of the contacts by virtue of the use of the contact element of conductive elastomeric material, the present invention makes it possible to form the contact electrodes by a printed circuit which has a low resistance to wear. According to this printed circuit, a plurality of contact electrodes can be very simply formed within a limited space. This advantage contributes greatly to the reduction in size and facility of manufacture of switching apparatus.

The switching apparatus according to the present invention is applicable to a variety of kinds of electrical circuits. For example, it is especially suitable for use as a wiper switch, or a light on-off switch or the like in an automobile.

It is an object of the present invention to provide a switching apparatus including a contact element of conductive elastomeric material and contact electrodes printed on an insulator base.

Another object of the present invention is to provide a slide switch structure including a contact element of conductive elastomeric material and contact electrodes printed on an insulator base.

Still another object of the present invention is to provide a snap switch structure including a contact element of conductive elastomeric material and contact electrodes printed on an insulator base.

Yet another object of the present invention is to provide a push switch structure of automatic resetting type including a contact element of conductive elastomeric material and contact electrodes printed on an insulator base.

DESCRIPTION OF THE PREFERRED EMBODIMENTS

Figure 1:
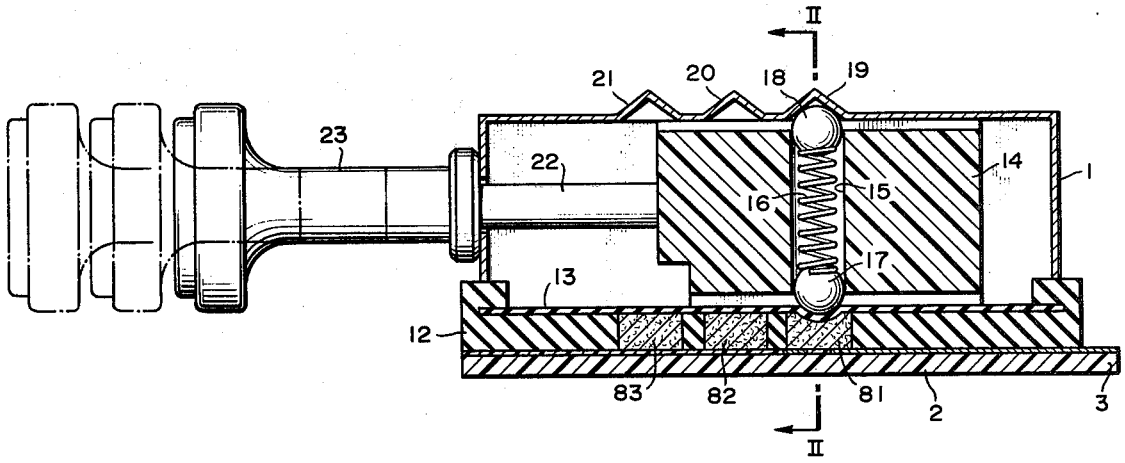
FIG. 1 is a partly cut-away front elevational view of a first embodiment of the present invention with parts in section to show the internal structure of the switch.
Figure 2:
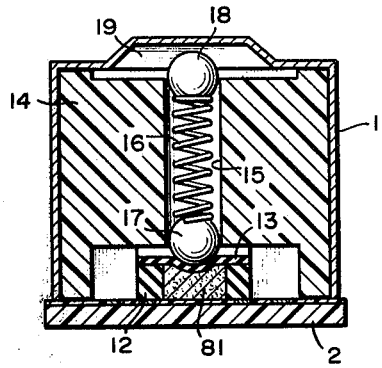
FIG. 2 is a section taken on the line II—II in FIG. 1.
Figure 3:
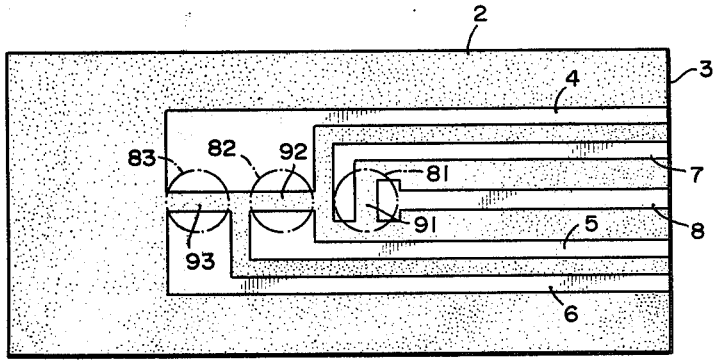
FIG. 3 is plan view showing contact electrodes printed on an insulator base shown in FIGS. 1 and 2.
Figure 4:
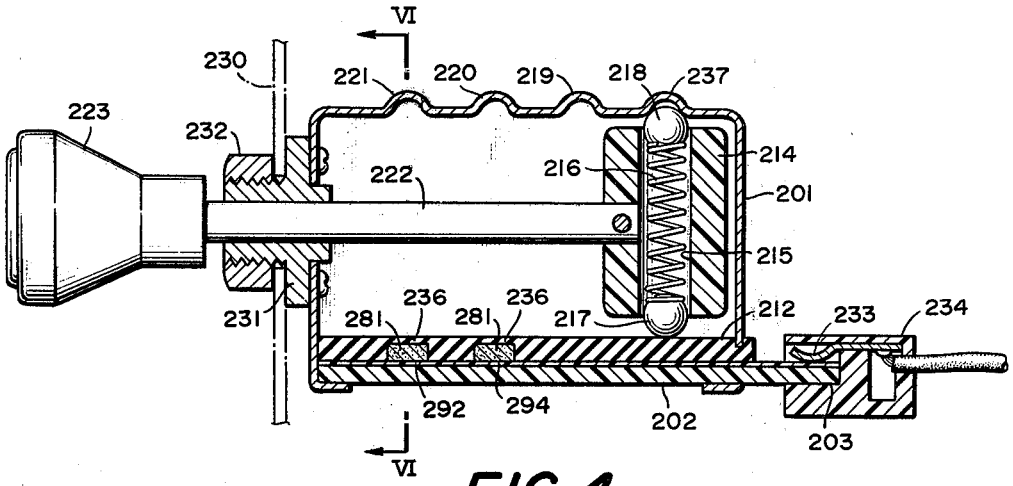
FIG. 4 is a partly cut-away front elevational view of a second embodiment of the present invention with parts in section to show the internal structure of the switch in the off position.

FIGS. 1 to 3 show a slide switch constructed in accordance with the present invention. The switch comprises a switch casing 1 having a bottom opening. An insulator base 2 constitutes the bottom of the switch casing 1, and a plurality of contact electrodes 4, 5, 6, 7 and 8 are formed by printed circuit technique on the upper surface of the insulator base 2 as shown in FIG. 3. The slide switch shown in FIGS. 1 to 3 is designed for use as a wiper switch for an automobile, and these printed contact electrodes provide a power supply circuit 4, a high-speed motor circuit 5, a low-speed motor circuit 6, an earthing circuit 7 and an auto stop circuit 8 respectively. One end of the earthing circuit 7 is opposed by the corresponding end of the auto stop circuit 8 through a narrow gap portion 91, and one end of the power supply circuit 4 is opposed by the corresponding end of the motor circuits 5 and 6 through respective narrow gap portions 92 and 93. The gap portions 91, 92 and 93 are disposed on the same line in substantially equally spaced-apart relation. One end 3 of the insulator base 2 projects outwardly beyond the corresponding part of the switch casing 1 so that the individual contact electrodes can be connected to external circuits.

A plurality of spaced contact elements 81, 82 and 83 of conductive elastomeric material are disposed on the insulator base 2 at positions opposite to the respective gap portions 91, 92 and 93 and are fixed in predetermined position by a holding member 12 of insulator such as rubber having slight resiliency. A thin flexible sheet 13 of wear-resisting insulator having a smooth surface is provided to cover the contact elements 81–83 and holding member 12. A slider 14 is disposed within the switch casing 1 so that it can make sliding movement in the direction of disposition of the gap portions 91, 92 and 93 while making sliding contact with portions of the insulator base 2. A bore 15 extends vertically through the slider 14, and a switching control ball 17 and a click ball 18 are received in the opposite ends of the bore 15 and are urged away from each other by a coil spring 16 interposed therebetween. The ball 17 acts as a means for imparting a compressing force to a selected one of the contact elements 81, 82 and 83. A plurality of spaced ball receiving recesses 19, 20 and 21 are formed on the top inner wall of the switch casing 1 at positions opposite to the respective gap portions 91, 92 and 93 isolating the control electrodes from one another. The slider 14 is connected to one end of a shaft 22 which extends to the exterior through the side wall of the switch casing 1, and a knob 23 is fixed to the other or outer end of the shaft 22.

The contact elements 81, 82 and 83 are made by dispersing fine particles of conductive metal in a mass of non-conductive elastomer such as porous or non-porous silicone rubber. These elements show a substantially infinite high electrical resistance in a non-compressed state, but with impartation of a compressing force thereto, the elastomer is compressed and the fine metal particles are brought into contact with one another to render the elements electrically conductive.

The slide switch illustrated in FIGS. 1 to 3 makes switching operation when the knob 23 is pushed or pulled to cause corresponding sliding movement of the slider 14 to bring the switching control ball 17 to any desired position above one of the contact elements 81, 82 and 83. The ball 17 is locked in the desired position by the click action of the click ball 18 engaging one of the ball receiving recesses 19, 20 and 21. In this state, the specific contact element is compressed by the ball 17 through the insulator sheet 13 and is rendered electrically conductive to establish electrical connection between the circuits at one of the narrow electrode gap portions 91, 92 and 93 corresponding to the compressed contact element.

FIGS. 4 to 7 show a second embodiment of the present invention. A switch casing 201 has an open bottom which is closed by an insulator base 202. A bushing 231 is fixed to one side wall of the switch casing 201 for mounting the switch casing 201 to a stationary member 230, and a mounting nut 232 is in threaded engagement with this bushing 231 to firmly hold the switch casing 201 in position.

Figure 5:
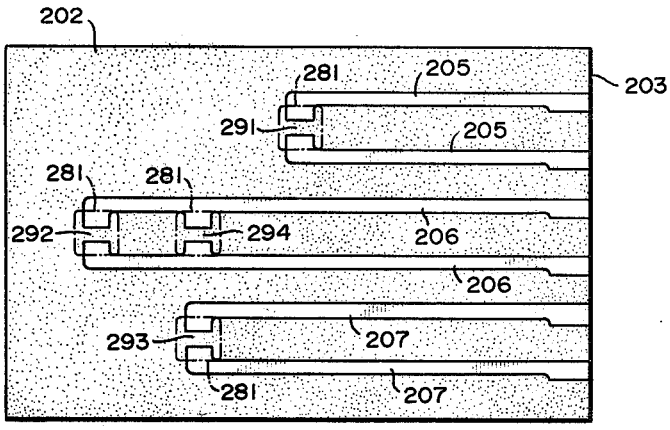
FIG. 5 is a plan view showing contact electrodes printed on an insulator base shown in FIG. 4.
Figure 6:
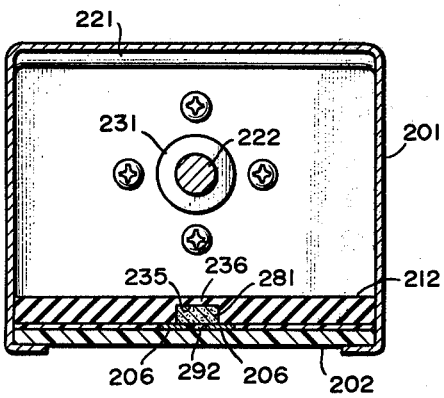
FIG. 6 is a section taken on the line VI—VI in FIG. 4.

A plurality of pairs of contact electrodes 205, 206 and 207 are formed on the upper surface of the insulator base 202 by printed circuit technique and extend in parallel relation from one end 203 of the insulator base 202 as shown in FIG. 5. Opposite ends of these contact electrodes 205, 206 and 207 are spaced from each other by respective narrow gap portions 291, 292 and 293. Further, portions of the contact electrodes 206 extend toward each other to define another gap portion 294 therebetween. The end 203 of the insulator base 202 projects outwardly beyond the corresponding part of the switch casing 201 so that a connector cup 234 having a plurality of parallel connectors 233 connected to the individual contact electrodes 205, 206 and 207 can be mounted on this end 203. A holding member 212 of resilient insulator such as rubber covers the insulator base 202 within the switch casing 201 and is fixed against movement. This holding member 212 is provided, on the lower surface thereof opposite to the upper surface of the insulator base 202, with a plurality of recesses 235 at positions opposite to the individual electrode gap portions 291, 292, 293 and 294 shown in FIG. 5. Due to the provision of the recesses 235 in the holding member 212, the resultant reduced thickness portions 236 of the holding member 212 have an increased ability of making elastic deflection compared with the remaining full-thickness portions. A contact element 281 of conductive elastomeric material is fitted in each of the recesses 235 of the holding member 212. These contact elements 281 are disposed to overlie the narrow electrode gap portions 291, 292, 293 and 294 between the pairs of the contact electrodes 205, 206 and 207. For example, one of the contact elements 281 is disposed to overlie the narrow electrode gap portion 292 between the pair of the contact electrodes 206 as seen in FIG. 6.

Figure 7:
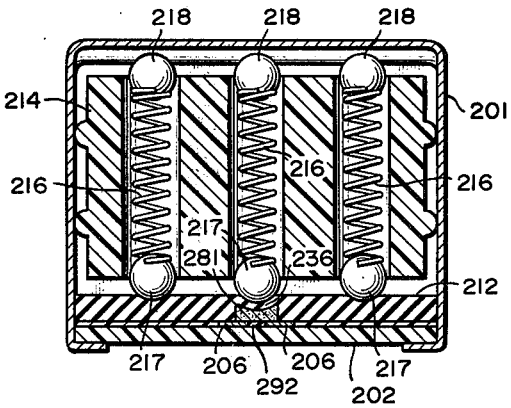
FIG. 7 is a sectional view of the switch when a slider is moved to the position of the line VI—VI in FIG. 4.
Figure 8:
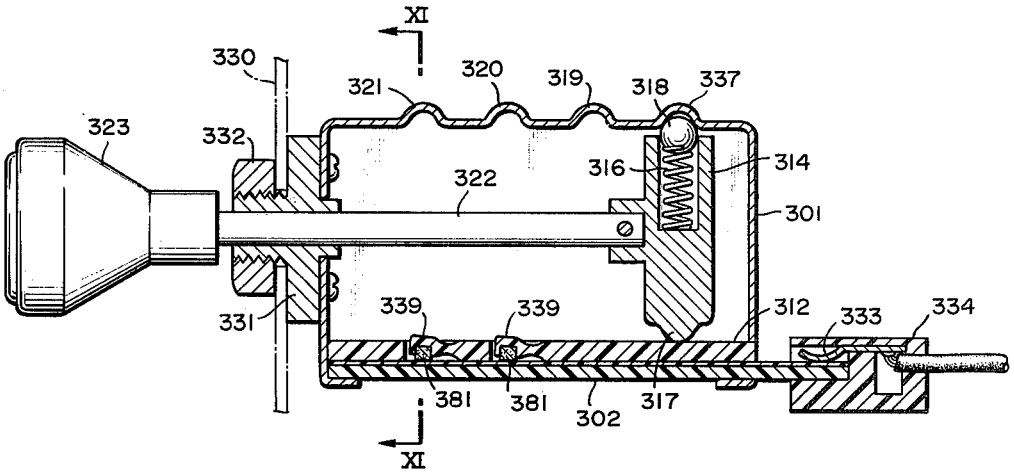
FIG. 8 is a partly cut-away front elevational view of a third embodiment of the present invention with parts in section to show the internal structure of the switch in the off position.

A plurality of spaced ball receiving recesses 219, 220, 221 and 237 are formed on the top inner wall of the switch casing 201. A slider 214 is received within the switch casing 201 so as to be slidable on the holding member 212, and a shaft 222 connected at one end to the slider 214 extends to the exterior of the switch casing 201 through the bushing 231. A knob 223 is fixed to the other or outer end of the shaft 222. A plurality of spaced bores 215 extend vertically through the slider 214 at positions opposite to the respective pairs of the printed contact electrodes 205, 206 and 207 as shown in FIG. 7. A click ball 218 and a pressure imparting ball 217 are received in the opposite ends of each of these bores 215 and are urged away from each other by a coil spring 216 interposed therebetween In this embodiment, the slider 214 makes sliding movement in the extending direction of the printed contact electrodes 205, 206 and 207 by pushing or pulling the knob 223. When the click balls 218 engage one of the ball receiving recesses 235, the pressure imparting balls 217 are locked in position. The number of the pressure imparting balls 217 is equal to the number of the printed contact electrode pairs 205, 206 and 207. These balls 217 are moved on the holding member 212 along the individual contact electrode pairs, and when the slider 214 is stopped at the desired position, one of these balls 217 engages one of the reduced thickness portions 236 of the holding member 212. When, for example, the click balls 218 engage the ball receiving recess 221 and one of the pressure imparting balls 217 engages the reduced thickness portion 236 overlying the narrow electrode gap portion 292 as shown in FIG. 7, the pressure imparting ball 217 is urged downward by the spring 216 to impart a compressing force to the underlying contact element 281 through the reduced thickness portion 236 thereby pressing this contact element 281 against the electrode gap portion 292.

In this state, the specific contact element 281 is rendered electrically conductive by the compressing force imparted by the ball 217 to establish electrical connection between the printed contact electrodes 206. Similarly, in the state in which the click balls 218 engage the ball receiving recess 220 with the sliding movement of the slider 214, electrical connection is established between the contact electrodes 206 and between the contact electrodes 207. Electrical connection is established between the contact electrodes 205 in the state in which the click balls 218 engage the ball receiving recess 219. No electrical connection is established in any of the contact electrode pairs in the state in which the click balls 218 engage the ball receiving recess 237.

Figure 9:
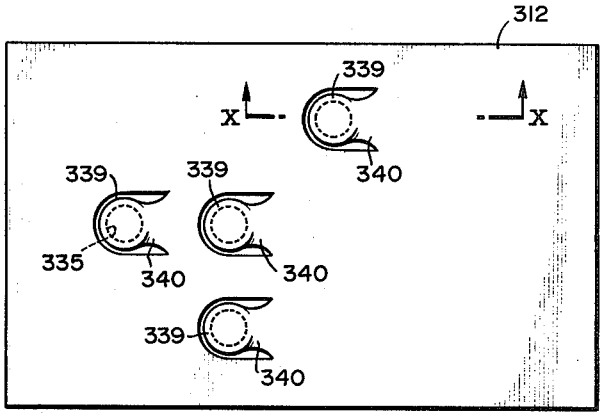
FIG. 9 is a plan view showing guide members disposed above individual contact elements.
Figure 10:
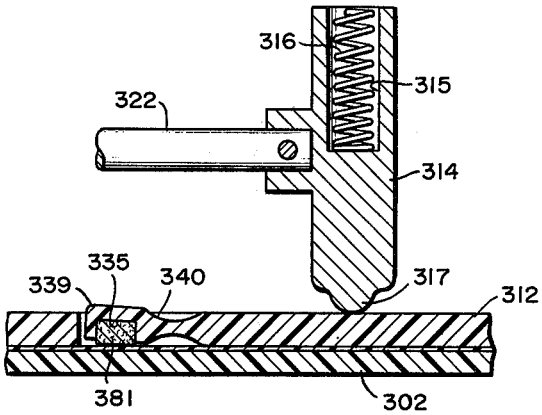
FIG. 10 is a section taken on the line X—X in FIG. 9.
Figure 11:
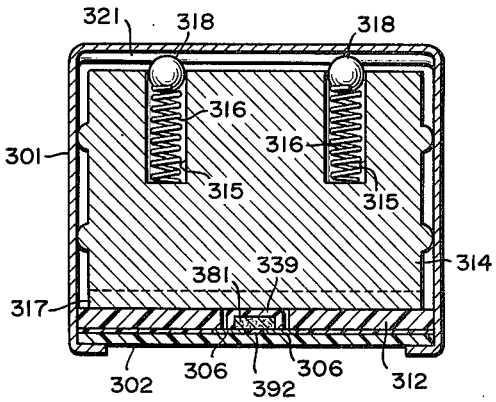
FIG. 11 is a sectional view of the switch when a slider is moved to the position of the line XI—XI in FIG. 8.

FIGS. 8 to 11 show a third embodiment of the present invention which is slightly different from the second embodiment shown in FIGS. 4 to 7. A holding member 312 is made of a synthetic resin which has a hardness slightly greater than that in the second embodiment. The holding member 312 is formed with a plurality of resilient tongues 339 at positions opposite to individual electrode gap portions as shown in FIGS. 9 and 10. A small projection 340 having a curved contour is formed on the upper surface of the free end of each of these tongues 339, and a portion of the lower surface of the free end of each tongue 339 is cut out to form a recess 335 for receiving therein a contact element 381 of conductive elastomeric material so that this contact element 381 engages in a non-compressed state with the associated electrode gap portion. A plurality of spaced vertical bores 315 having a closed bottom are formed in a slider 314, and, in each bore 315, a coil spring 316 is compressed between a click ball 318 received in the upper end of the bore 315 and the bottom of the bore 315. These balls 318 are engageable with a plurality of spaced ball receiving recesses 319, 320, 321 and 337 formed on the top inner wall of a switch casing 301. A pressure imparting projection 317 extends from the lower end of the slider 314. Other parts are similar to those of the second embodiment and are designated by merely adding "100" to the reference numerals of like parts shown in FIGS. 4 to 7.

In operation, the projection 317 of the slider 314 engages successively the small projection 340 of the tongues 339 with the sliding movement of the slider 314, and the tongue 339 engaged by the projection 317 is deflected to impart a compressing force to the associated contact element 381. The contact element 381 which is rendered electrically conductive is pressed against the associated electrode gap portion to establish electrical connection between the associated contact electrodes. Thus, the third embodiment makes a slide switch action similar to that of the second embodiment.

Figure 12:
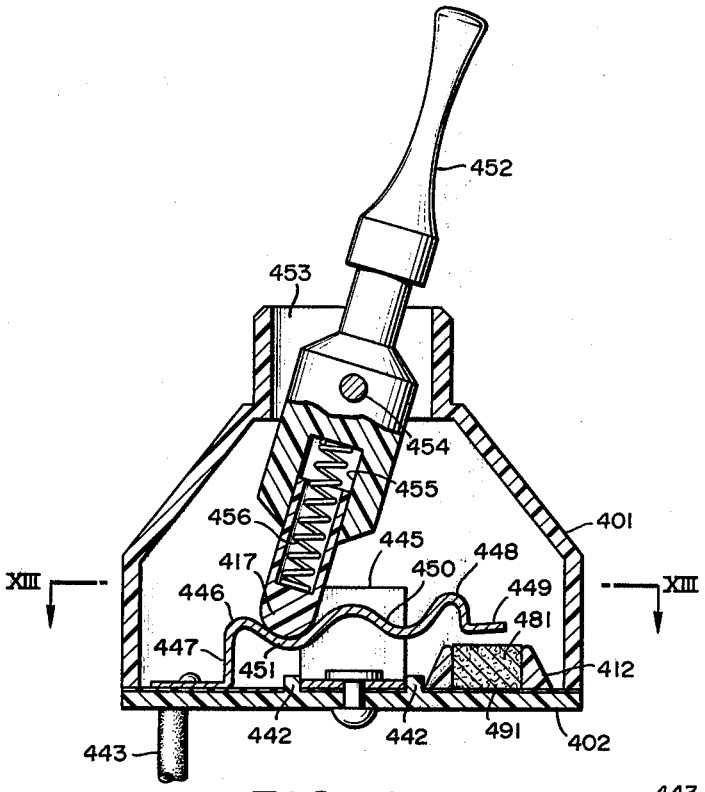
FIG. 12 is a partly cut-away front elevational view of a fourth embodiment of the present invention with parts in section to show the internal structure of the switch in the off position.
Figure 13:
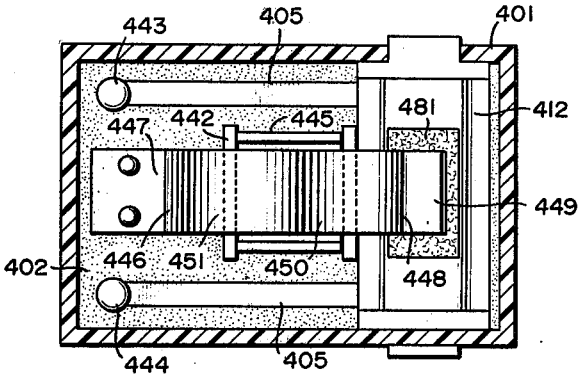
FIG. 13 is a section taken on the line XIII—XIII in FIG. 12 with a pressure imparting member removed.
Figure 14:
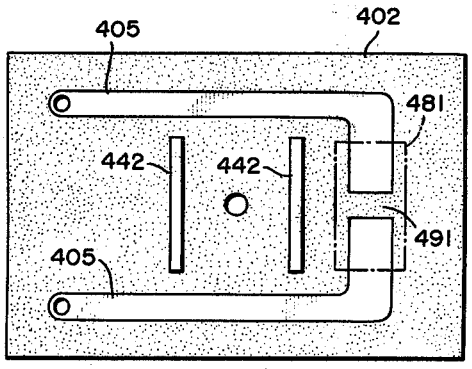
FIG. 14 is a plan view of an insulator base shown in FIGS. 12 and 13.

FIGS. 12 to 14 show a fourth embodiment of the present invention applied to a snap switch. A switch casing 401 has an open bottom which is closed by an insulator base 402. As shown in FIG. 14, a pair of supporting ridges 442 are provided in parallel relation at a central portion of the upper surface of the insulator base 402, and a pair of contact electrodes 405 are formed or printed on the insulator base 402 outside of the ridges 442. Opposite ends of the contact electrodes 405 are spaced from each other by a narrow gap portion 491. A pair of lead wires or terminals 443 and 444 extend through the insulator base 402 into the switch casing 401 to be connected as by soldering to the respective contact electrodes 405.

A contact element 481 of conductive elastomeric material is supported in a holding member 412 fixed to the insulator base 402 and is disposed to overlie the narrow electrode gap portion 491. A U-shaped protective frame member 445 is mounted on the insulator base 402 by being fitted between the supporting ridges 442. A click spring 446 consists of an upstanding leg 447 and a horizontally extending resilient strip 448. A pressure imparting portion 449 is formed at the free end of the resilient strip 448, and the middle portion of the resilient strip 448 is corrugated to form a pair of spaced concavities 450 and 451. The pressure imparting portion 449 of the resilient strip 448 extending loosely through the space in the U-shaped protective frame member 445 overlies the contact element 481, and the upstanding leg 447 of the spring 446 is fixed to the insulator base 402. A snap lever 452 extends into the switch casing 401 through an opening 453 and is pivoted to the switch casing 401 by a pivot 454. A bore 455 having a closed upper end is formed in the lower end portion of the snap lever 452 to receive a coil spring 456 and a pressure imparting member 417 therein. This pressure imparting member 417 is engageable with any one of the concavities 450 and 451 formed on the click spring 446.

In FIG. 12, the pressure imparting member 417 carried by the snap lever 452 is shown engaged by the concavity 451. In such a state, the pressure imparting portion 449 of the click spring 446 is in a position in which it is slightly spaced from the contact element 481, and no compressing force is imparted to the contact element 481. Then, when the snap lever 452 is swung to an opposite position, to cause engagement of the pressure imparting member 417 with the concavity 450, the contact element 481 is rendered electrically conductive by the force imparted by the pressure imparting portion 449 and establishes electrical connection between the printed contact electrodes 405 at the electrode gap portion 491 thereby turning on the switch.

Figure 15:
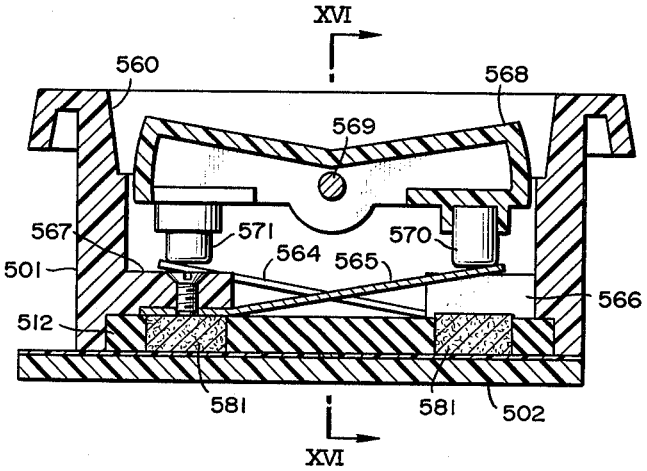
FIG. 15 is a partly cut-away front elevational view of a fifth embodiment of the present invention with parts in section to show the internal structure of the switch in the off position.
Figure 16:
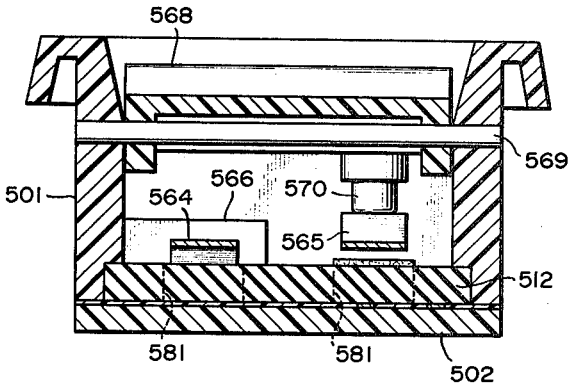
FIG. 16 is a section taken on the line XVI—XVI in FIG. 15.
Figure 17:
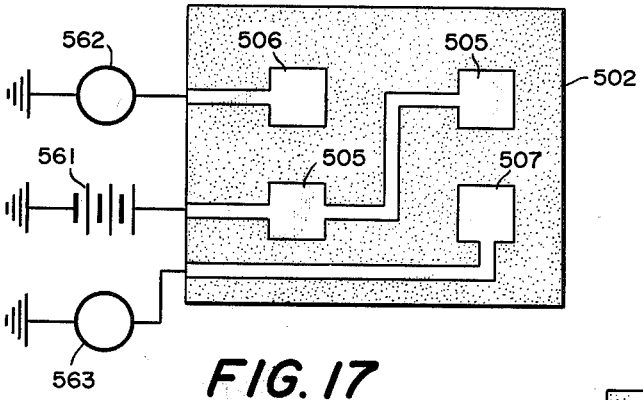
FIG. 17 is a plan view showing contact electrodes printed on an insulator base shown in FIGS. 15 and 16.

FIGS. 15 to 17 show a fifth embodiment of the present invention applied to a push switch of automatic resetting type. A switch casing 501 having a wide opening 560 is closed at the bottom thereof by an insulator base 502. As shown in FIG. 17, two contact electrodes 505 are connected to a power supply circuit 561, and two contact electrodes 506 and 507 are connected to respective load circuits 562 and 563. These contact electrodes are formed on the upper surface of the insulator base 502 by printed circuit technique. Two pairs of contact elements 581 of conductive elastomeric material are disposed on the insulator base 502 at suitable positions opposite to these contact electrodes so that electrical connection between one of the contact electrodes 505 and the contact electrode 506 and between the other contact electrode 505 and the contact electrode 507 can be established as desired. These contact elements 581 are fitted in a holding member 512 of resilient insulator such as rubber. A leaf spring 564 is fixed at one end thereof to be in pressure imparting contact with one of the contact elements 581 in the first pair and is spaced at the other or free end thereof from the other contact element 581 in the same pair. Another leaf spring 565 is fixed at one end thereof to be in pressure imparting contact with one of the contact elements 581 in the second pair and is spaced at the other or free end thereof from the other contact element 581 in the same pair. The fixed ends of the leaf springs 564 and 565 are fixed by screws to respective lugs 566 and 567 extending from the inner walls of the switch casing 501.

A push button 568 in the form of a seesaw-like swinging member is supported in a central portion of the wide opening 560 by a pivot 569 extending in a direction perpendicular to the extending direction of the leaf springs 564 and 565. A pair of spaced pressure imparting members 570 and 571 are mounted on the lower part of the push button 568 and are normally engaged by the free ends of the respective leaf springs 564 and 565 to maintain the push bottom 568 in a neutral position as shown in FIG. 15. The leaf springs 564 and 565 act to maintain the push button 568 in the neutral position, and at the same time, to cause automatic resetting movement of the push button 568 as soon as the pressure imparted to the push button 568 is released.

In operation, the push button 568 is depressed to press the free end of the leaf spring 564 or 565 against the associated contact element 581 through the pressure imparting member 570 or 571 thereby establishing electrical connection between the desired contact electrodes. When the pressure imparted to the push button 568 is released, the push button 568 is automatically reset to the neutral position shown in FIG. 15.

Figure 18:
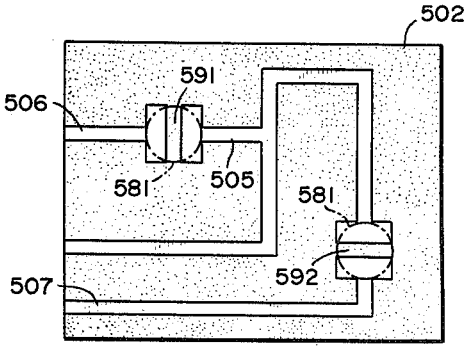
FIG. 18 is a view similar to FIG. 17 but showing a contact electrode arrangement slightly different from that shown in FIG. 17.

FIG. 18 shows a modification of the contact electrode arrangement shown in FIG. 17. Referring to FIG. 18, narrow gap portions 591 and 592 are provided between one of the contact electrodes 505 and the contact electrode 506 and between the other contact electrode 505 and the contact electrode 507 respectively, and the contact elements 581 are disposed to overlie these electrode gap portions 591 and 592. This modification is advantageous in that the number of the contact elements can be reduced.

I claim:

1. An electrical switch for selectively opening and closing a plurality of contacts comprising:

a base member formed of an electrical insulating material and having a first surface which defines therein a plurality of apertures, contact electrode means on said first surface for defining a plurality of circuit paths thereon each of which extends to at least one of said apertures and is normally open circuited at the location of said aperture, a contact element of elastomeric material of the type which becomes electrically conductive upon compression and being supported in each said aperture in said base member, and slider means movable laterally over said first surface between preselected positions, said slider means including at least one pressure imparting means which exerts a compression force in a direction normal to the direction of movement of said slider means, said force imparting means being so positioned relative to said apertures in said first surface that in at least one of said preselected positions of said slider means said force imparting means compresses a respective control element and closes a circuit path associated with said aperture.

2. The switch of claim 1 in which said first surface is planar.

3. The switch of claim 1 in which said slider means is movable in a switch casing which includes a click mechanism for stopping movement of said slider means at each of said preselected positions.

4. The switch of claim 3 wherein said click mechanism includes a click ball carried by said slider means and a plurality of ball engaging recesses formed in said switch casing.

5. The switch of claim 3 wherein said pressure imparting means includes a ball which is received in a bore formed in said slider means and which is urged toward said insulator base member by a spring.

6. The switch of claim 1 wherein a compression spring is interposed between said pressure imparting ball and said click ball in said click mechanism.

7. The switch of claim 1 wherein said pressure imparting means includes a projection formed as an integral part of said slider means.

8. A switching apparatus as claimed in claim 1, wherein said contact electrodes in each pair are spaced apart from each other by a narrow gap portion, and the corresponding one of said contact elements is disposed to overlie said narrow electrode gap portion.

9. A switching apparatus as claimed in claim 8, wherein a plurality of such narrow electrode gap portions are disposed on a straight line extending in the sliding direction of said slider.

10. A switching apparatus as claimed in claim 8, wherein a thin flexible sheet of wear-resisting insulator having a smooth surface is disposed between said pressure imparting means and said contact elements.

11. A slide switch structure comprising a switch casing, an insulator base fixed to said switch casing, a plurality of pairs of contact electrodes printed on said insulator base to be connected to external circuits, a plurality of contact lements of elastomeric material of the type which becomes electrically conductive upon compression and disposed on said insulator base at suitable positions opposite to said contact electrode pairs, a holding member for holding said contact elements in predetermined position on said insulator base, and actuating means including pressure imparting means for imparting a compressing force to said contact elements and a slider for causing sliding movement of said pressure imparting means to a compressing position and a non-compressing position for said contact elements, whereby the switch is turned on when any one of said contact elements is compressed and turned off when none of said contact elements are compressed, and a click mechanism being provided between said slider and said switch casing so that said pressure imparting means can be stopped at a plurality of positions in which said pressure imparting means engages said contact elements.

12. A switching apparatus as claimed in claim 11, wherein said click mechanism includes a click ball carried by said slider and a plurality of ball engaging recesses formed in said switch casing.

13. A slide switch structure comprising a switch casing, an insulator base fixed to said switch casing, a plurality of pairs of contact electrodes printed on said insulator base to be connected to external circuits, a plurality of contact elements of elastomeric material of the type which becomes electrically conductive upon compression and disposed on said insulator base at suitable positions opposite to said contact electrode pairs, a holding member for holding said contact elements in predetermined position on said insulator base, and actuating means including pressure imparting means for imparting a compressing force to said contact elements and a slider for causing sliding movement of said pressure imparting means to a compressing position and a non-compressing position for said contact elements, whereby the switch is turned on when any one of said contact elements is compressed and turned off when none of said contact elements are compressed, said pressure imparting means including a ball which is received in a bore formed in said slider and which is urged toward said insulator base by a spring.

14. A switching apparatus as claimed in claim 13, wherein a compression spring is interposed between said pressure imparting ball and said click ball in said click mechanism.

15. A slide switch structure comprising a switch casing, an insulator base fixed to said switch casing, a plurality of pairs of contact electrodes printed on said insulator base to be connected to external circuits, a plurality of contact elements of elastomeric material of the type which becomes externally conductive upon compression and disposed on said insulator base at suitable positions opposite to said contact electrode pairs, a holding member for holding said contact elements in predetermined position on said insulator base, and actuating means including pressure imparting means for imparting a compressing force to said contact elements and a slider for causing sliding movement of said pressure imparting means to a compressing position and a non-compressing position for said contact elements, whereby the switch is turned on when any one of said contact elements is compressed and turned off when none of said contact elements are compressed, said pressure imparting means including a projection formed as an integral part of said slider.

* * * * *

UNITED STATES PATENT AND TRADEMARK OFFICE

CERTIFICATE OF CORRECTION

PATENT NO. : 3,983,355

DATED : September 28, 1976

INVENTOR(S) : Masayoshi Hyodo

It is certified that error appears in the above-identified patent and that said Letters Patent are hereby corrected as shown below:

Foreign Application Priority Data

June 21, 1973 Japan. . . . . .73866/73

Signed and Sealed this

First Day of March 1977

[SEAL]

*Attest:*

RUTH C. MASON
*Attesting Officer*

C. MARSHALL DANN
*Commissioner of Patents and Trademarks*